US009254934B2

(12) United States Patent
Dabek et al.

(10) Patent No.: US 9,254,934 B2
(45) Date of Patent: Feb. 9, 2016

(54) CARRIER PLATE FOR CONVEYOR-BASED FILLING SYSTEM

(71) Applicant: Modern Packaging, Inc., Deer Park, NY (US)

(72) Inventors: Jaroslaw Dabek, Lake Grove, NY (US); Syed Z. Hossain, Hicksville, NY (US)

(73) Assignee: Modern Packaging, Inc., Deer Park, NY (US)

( * ) Notice: Subject to any disclaimer, the term of this patent is extended or adjusted under 35 U.S.C. 154(b) by 0 days.

(21) Appl. No.: 14/339,290

(22) Filed: Jul. 23, 2014

(65) Prior Publication Data

US 2015/0027855 A1 Jan. 29, 2015

Related U.S. Application Data

(60) Provisional application No. 61/857,545, filed on Jul. 23, 2013.

(51) Int. Cl.

| | |
|---|---|
| ***B65G 17/34*** | (2006.01) |
| ***B65B 43/52*** | (2006.01) |
| ***B65B 43/56*** | (2006.01) |
| *B65B 3/00* | (2006.01) |
| *B65B 7/16* | (2006.01) |

(52) U.S. Cl.

CPC ..... *B65B 43/52* (2013.01); *B65B 43/56* (2013.01); *B65B 3/00* (2013.01); *B65B 7/164* (2013.01)

(58) Field of Classification Search

CPC ..... B65G 17/32; B65G 17/12; B65G 2201/0244; B65G 2201/0261

USPC ..... 198/867.12, 803.15, 850

See application file for complete search history.

(56) References Cited

U.S. PATENT DOCUMENTS

| | | | | |
|---|---|---|---|---|
| 3,575,713 | A * | 4/1971 | Duff et al. | 198/803.15 |
| 3,981,389 | A * | 9/1976 | Babunovic et al. | 198/803.15 |
| 4,033,450 | A * | 7/1977 | Paddock et al. | 198/867.08 |
| 4,588,066 | A * | 5/1986 | Kaminski | 198/803.15 |
| 4,684,012 | A * | 8/1987 | Feddersen | 198/867.05 |
| 7,306,092 | B1 * | 12/2007 | Heinzl et al. | 198/867.12 |

* cited by examiner

*Primary Examiner* — James R Bidwell

(74) *Attorney, Agent, or Firm* — Carter, DeLuca, Farrell & Schmidt, LLP

(57) ABSTRACT

A carrier plate configured for use with a filling system including a conveyor and at least one filling nozzle includes a plurality of spaced-apart plate segments interconnected by one or more receiving members. The carrier plate is movable along the conveyor and relative to the at least one nozzle. Each nozzle is configured to dispense product into the container supported by the corresponding receiving member and is aligned between the corresponding adjacent plate segments such that, upon movement of the carrier plate along the conveyor and relative to the at least one nozzle, each nozzle passes through the gap defined between the corresponding pair of adjacent plate segments.

11 Claims, 1 Drawing Sheet

CARRIER PLATE FOR CONVEYOR-BASED FILLING SYSTEM

CROSS-REFERENCE TO RELATED APPLICATIONS

This application claims the benefit of and priority to U.S. Provisional Patent Application No. 61/857,545, filed on Jul. 23, 2013, the entire contents of which are hereby incorporated herein by reference.

BACKGROUND

1. Technical Field

The present disclosure relates to product packaging and, more particularly, to a carrier plate for use in a conveyor-based filling system.

2. Background of Related Art

Conveyor-based filling systems typically include a conveyor, one or more carrier plates, one or more filling stations, and one or more sealing stations. Each carrier plate is configured to retain one or more receptacles, e.g., cups, to be filled and is moved along the conveyor, continuously or incrementally, initially to the filling station and subsequently to the sealing station. At the filing station, alignment of the carrier plate and properly timed dispensing of the product ensure the appropriate amount of product is dispensed into each cup. However, despite precision alignment and timing, excess product may drip from the dispensing nozzle onto the carrier plate, even during proper operation of the filling system. With respect to the sealing station, alignment of the carrier plate ensures that the carrier plate can be properly clamped for heat sealing a film cover about a lip of the cup and for cutting the film cover between the cups. However, where excess product has dripped onto the carrier plate, the sealing, and/or cutting of the film cover about the cup may be compromised.

SUMMARY

In accordance with the present disclosure, a carrier plate configured for use in a filling system including a conveyor and at least one product-dispensing nozzle is provided. The carrier plate includes a plurality of spaced-apart plate segments and at least one receiving member. Each pair of adjacent plate segments defines a gap therebetween. The receiving member is disposed within the gap between each pair of adjacent plate segments. Each receiving member is configured to retain a container to be filled with product. Each receiving member and corresponding gap is disposed on a travel axis extending transverse relative to the plurality of spaced-apart plate segments. The carrier plate is movable along the conveyor and relative to the at least one nozzle. Each nozzle is configured to dispense product into one of the containers and is aligned on the corresponding travel axis such that, upon movement of the carrier plate along the conveyor and relative to the at least one nozzle, each nozzle passes through the gap defined between the corresponding pair of adjacent plate segments. Thus, positioning of the nozzles directly above any portion of the plate segments is avoided and, as a result, dripping of excess product onto the plate segments is inhibited.

In embodiments, each plate segment defines an opposed recessed shoulder. The receiving members are configured to be at least partially seated within the opposed recessed shoulders of the corresponding pair of adjacent plate segments.

In embodiments, the opposed recessed shoulders define arcuate configurations. In such embodiments, the receiving members are configured as receiving rings and, further, may be configured to receive cups into which product is to be dispensed.

In embodiments, the receiving members are fixed between the adjacent plate segments. Alternatively, the receiving members may be removable therefrom.

In embodiments, the travel axes are disposed in parallel orientation relative to one another.

In embodiments, the plurality of spaced-apart plate segments include first and second end plate segments and at least one intermediate plate segment disposed between the first and second end plate segments.

In embodiments, the first and second end plate segments each define at least one engagement member configured to facilitate engagement of the carrier plate to the conveyor.

In embodiments, the first and second end plates each define one opposed recessed shoulder configured to at least partially receive one of the receiving members therein. The intermediate plate segments, on the other hand, each define a pair of opposed recessed shoulders each of which is configured to at least partially receive one of the receiving member therein.

In embodiments, the gaps define widths greater than a width of a drop area of the at least one nozzle.

BRIEF DESCRIPTION OF THE DRAWINGS

Various embodiments of the present disclosure are described hereinbelow with references to the drawings, wherein.

DETAILED DESCRIPTION OF THE EMBODIMENTS

Figure 1:
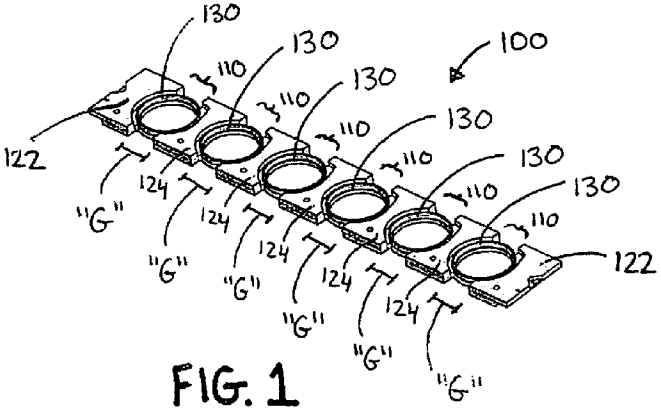
FIG. 1 is a perspective view of a carrier plate provided in accordance with the present disclosure.
Figure 3:
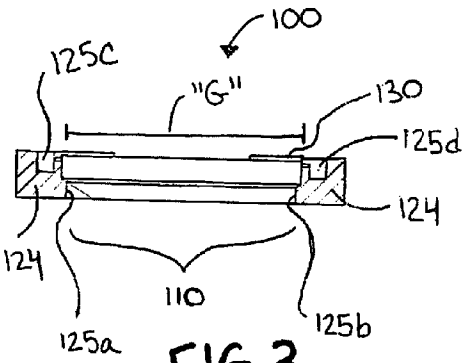
FIG. 3 is a transverse, cross-sectional view taken along section line "3-3" of FIG. 2.
Figure 2:
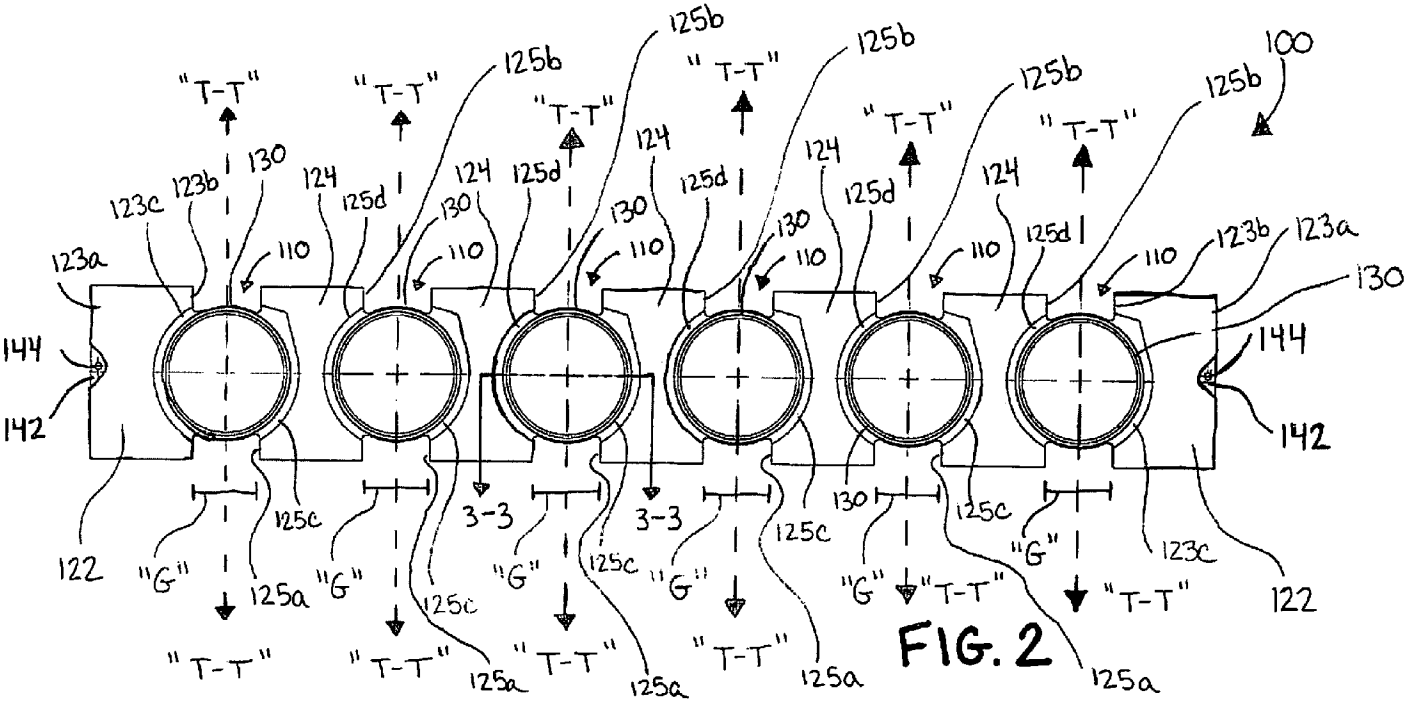
FIG. 2 is a top view of the carrier plate of FIG. 1.

Turning to FIGS. 1-3, a carrier plate provided in accordance with the present disclosure is shown and generally identified by reference numeral 100. Carrier plate 100 includes a plurality of receptacle regions 110, each configured to receive a cup (or other suitable container) to be filled with product via a conveyor-based filling system or other suitable automated filling system. Although shown including six (6) receptacle regions 110, it is envisioned that carrier plate 100 may include greater or fewer receptacle regions 110, depending upon the particular conveyor-based filling system used and/or the product being dispensed.

Carrier plate 100 includes a plurality of spaced-apart plate segments aligned in generally parallel orientation relative to one another, including a pair of end plate segments 122 and a plurality of intermediate plate segments 124 disposed between the end plate segments 122. As best shown in FIG. 2, the plate segments 122, 124 or 124, 124 are spaced-apart from one another such that each pair of adjacent plate segments 122, 124 or 124, 124 defines a gap "G" therebetween. Although gaps "G" are shown as being similarly dimensioned, it is envisioned that different gap widths be provided for use with conveyor-based filling systems having various different nozzle configurations.

End plate segments 122 each define an outer edge 123*a* and an inner edge 123*b* including a recessed shoulder 123*c*. Recessed shoulder 123*c* may define an arcuate configuration, although other configurations are also contemplated. End plate segments 122 may each further include an engagement lip 142 and/or engagement aperture 144 (or other suitable engagement structure) configured to facilitate securement and proper alignment of carrier plate 100 on a conveyor-based filling system.

Each intermediate plate segment 124 defines first and second opposed edges 125*a*, 125*b*, each including a recessed shoulder 125*c*, 125*d*, respectively. Recessed shoulders 124*c*, 125*d*, similarly as with recessed shoulder 123*c*, may define arcuate configurations, although other configurations are also contemplated.

A receiving ring 130 is positioned between each pair of adjacent plate segments 122, 124 or 124, 124 and is partially seated within the adjacent recessed shoulders 123*c*, 125*c* or 125*c*, 125*d* thereof. More specifically, the adjacent recessed shoulders 123*c*, 125*c* or 125*c*, 125*d* are shaped complementary to receiving ring 130 to receive a portion thereof and retain receiving ring 130 between the adjacent recessed shoulders 123*c*, 125*c* or 125*c*, 125*d*. Receiving rings 130 may be permanently fixed in this position, e.g., via welding, adhesions, or other suitable process, or may be removable. In embodiments where receiving ring 130 is provided as shown in FIGS. 1-3, the adjacent recessed shoulders 123*c*, 125*c* or 125*c*, 125*d* are arcuate, as detailed above. Alternatively, where a different-shaped receiving member is provided, the adjacent recessed shoulders 123*c*, 125*c* or 125*c*, 125*d* may be configured complementarily thereto. Each receiving ring 130 (or receiving member) is configured to receive a cup (or other suitable container) to be filled, with a lip of the cup supported by the respective ring 130, e.g., seated within the complementarily-shaped ring 130.

The gap "G" between each pair of adjacent plate segments 122, 124 and the respective receiving ring 130 spanning each gap "G" together define the plurality of receptacle regions 110 of carrier plate 100. Each receptacle region 110 defines a travel axis "T-T" that bisects the corresponding receiving ring 130 with a portion, e.g., half, of the corresponding gap "G" disposed on either side of the travel axis "T-T." As can be appreciated, the travels axes "T-T" defined by each receptacle region 110 of carrier plate 100 extend in generally parallel orientation relative to one another. As a result of the above-detailed configuration, the plate segments 122, 124 or 124, 124 of carrier plate 100 are spaced-apart from the travel axes "T-T" of the carrier plate 100, the importance of which is detailed below.

In use, carrier plate 100 is mounted, retained, or otherwise oriented transversely on a conveyor filling system such that each of receptacle regions 110 is disposed in a filling lane of the conveyor filling system with the respective travel axis "T-T" centered relative to the corresponding filling lane. Each filling lane is defined by a path connecting the set of nozzles associated with each lane of the conveyor-based filling system. The width dimension of each filling lane is defined by the drop areas, e.g., the product dispensement areas, defined by the nozzles thereof (or the drop area or the largest nozzle of the corresponding set of nozzles). The number of filling lanes of the conveyor-based filling system corresponds to the number of receptacle regions 110 of the conveyor plate 100, although it is also contemplated that the number of filling lanes be greater than that of receptacle regions 110. In the exemplary embodiment, since the conveyor plate 100 defines six (6) receptacle regions 110, the conveyor would define at least six (6) conveyor lanes, one for each receptacle region 110 of carrier plate 100.

As noted above, each of the receptacle regions 110 is centered on and translatable along a travel axis "T-T." Carrier plate 100 and the conveyor-based filling system are configured such that each travel axis "T-T" is centered relative to the corresponding filling lane upon engagement of the carrier plate 100 with the conveyor-based filling system and as the carrier plate 100 is translated along the conveyor-based filling system. Further, the gap "G" defined by each pair of adjacent plate segments 122, 124 or 124, 124 has a width that is greater than that of the corresponding filling lane, meaning that each gap "G" defines a width greater than the width of the drop area of the corresponding nozzles (or largest nozzle). As such, during a filling operation, carrier plate 100 is moved along the conveyor such that each receptacle region 110 is moved in its corresponding filling lane, along its corresponding travel axis "T-T," to one or more filling stations. More specifically, carrier plate 100 is moved, continuously or incrementally, to one or more filling stations wherein, at each filling station, a nozzle or other suitable dispenser is aligned above each of the cups retained in the respective receptacle regions 110. Once such alignment has been achieved, each of the nozzles dispenses a pre-determined amount of product into the cup.

Since each nozzle along the filling lane is aligned on the corresponding travel axis "T-T" of each receptacle region 110, and since the width of the gap "G" of each receptacle region 110 is greater than the drop area defined by the nozzle, no portion of any of the plate segments 122, 124 intersects the filling lanes. As a result, in the event excess product drips from the nozzle before or after dispensing, such drippings pass through the gap "G" between plate segments 122, 124 or 124, 124, rather than landing on any of the plate segments 122, 124. As can be appreciated, such a configuration inhibits carrier plate 100 from becoming soiled during the filling process.

After filling, carrier plate 100 is advanced to a sealing station, wherein the carrier plate 100 is clamped adjacent each receptacle region 110, a film cover is heat sealed about the outer peripheral lip of each cup, and the film cover is cut between each of the cups. As can be appreciated, with no drippings of product disposed on carrier plate 100, adequate sealing of each of the cups and cutting of the film covers can be readily achieved.

From the foregoing and with reference to the various figure drawings, those skilled in the art will appreciate that certain modifications can also be made to the present disclosure without departing from the scope of the same. While several embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of particular embodiments.

What is claimed is:

1. A filling system, comprising:

a conveyor;

a nozzle; and a carrier plate, including:

a plurality of spaced-apart plate segments, each pair of adjacent plate segments defining a gap therebetween; and a receiving member disposed within each gap and coupled between the corresponding pair of adjacent plate segments on either side of the gap, each receiving member configured to retain a container to be filled with product, each receiving member and corresponding gap aligned on a travel axis extending transverse relative to the plurality of spaced-apart plate segments, wherein, the carrier plate is movable along the conveyor and relative to the nozzle, the nozzle configured to dispense product into one of the containers and align on the corresponding travel axis such that, upon movement of the carrier plate along the conveyor and relative to the nozzle, the nozzle passes through the gap defined between the corresponding pair of adjacent plate segments.

2. The filling system according to claim 1, wherein each plate segment defines an opposed recessed shoulder, each receiving member configured to be at least partially seated within the opposed recessed shoulders of the corresponding pair of adjacent plate segments.

3. The filling system according to claim 2, wherein the opposed recessed shoulders define arcuate configurations.

4. The filling system according to claim 3, wherein the receiving member is a receiving ring.

5. The filling system according to claim 4, wherein the receiving ring is configured to receive a cup into which product is to be dispensed.

6. The filling system according to claim 1, wherein the receiving member is fixed between the adjacent plate segments.

7. The filling system according to claim 1, wherein each one of the travel axes is disposed in parallel orientation relative to each of the other travel axes.

8. The filling system according to claim 1, wherein the plurality of spaced-apart plate segments include first and second end plate segments and at least one intermediate plate segment disposed between the first and second end plate segments.

9. The filling system according to claim 8, wherein the first and second end plate segments each define at least one engagement member configured to facilitate engagement of the carrier plate to the conveyor.

10. The filling system according to claim 8, wherein the first and second end plates each define one opposed recessed shoulder configured to at least partially receive one of the receiving members therein, and wherein each of the intermediate plate segments defines a pair of opposed recessed shoulders each configured to at least partially receive one of the receiving member therein.

11. The filling system according to claim 1, wherein each gap defines a width that is greater than a width of a drop area of the corresponding nozzle.

* * * * *